US006288500B1

(12) United States Patent
Klier

(10) Patent No.: US 6,288,500 B1
(45) Date of Patent: Sep. 11, 2001

(54) CIRCUIT ARRANGEMENT FOR DETECTING RECTIFICATION OF DISCHARGE LAMPS

(75) Inventor: Juergen Klier, Traunreut (DE)

(73) Assignee: Patent Truhand-Gesellschaft fuer elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/509,986

(22) PCT Filed: Apr. 1, 1999

(86) PCT No.: PCT/DE99/01010

§ 371 Date: Apr. 5, 2000

§ 102(e) Date: Apr. 5, 2000

(87) PCT Pub. No.: WO00/11916

PCT Pub. Date: Mar. 2, 2000

(30) Foreign Application Priority Data

Aug. 20, 1998 (DE) ..... 198 37 728

(51) Int. Cl.[7] ..... H02M 5/458; H05B 37/02
(52) U.S. Cl. ..... 315/209 R; 315/224; 315/307
(58) Field of Search ..... 315/209 R, 241 R, 315/224, 225, 244, 291, 307, 360

(56) References Cited

U.S. PATENT DOCUMENTS 5,703,439 * 12/1997 Nerone ..... 315/219
5,777,861 * 7/1998 Shimizu et al. ..... 315/209 R
6,060,843 * 5/2000 Primisser et al. ..... 315/307

FOREIGN PATENT DOCUMENTS 0681414 11/1995 (EP) .
0753987 1/1997 (EP) .
0886460 12/1998 (EP) .
9743879 11/1997 (WO) .

* cited by examiner

*Primary Examiner*—Don Wong
*Assistant Examiner*—Wilson Lee
(74) *Attorney, Agent, or Firm*—Carlo S. Bessone

(57) ABSTRACT

The invention relates to a circuit arrangement for operating at least one discharge lamp, the circuit arrangement having a half-bridge inverter (Q10, Q11) with a downstream load circuit (L1, C10, LP1, C11), at least one coupling capacitor (C11) which is connected to the load circuit (L1, C10, LP1, C11) and to the half-bridge inverter (Q10, Q11), and a drive device (A1) of the half-bridge inverter (Q10, Q11). According to the invention, the circuit arrangement has a reference voltage source (R13, R14) and a detector circuit (DE1) which detector circuit compares the voltage drop across the at least one coupling capacitor (C11) or the voltage drop, divided downwards by a voltage divider, across the at least one coupling capacitor (C11) with the reference voltage of the reference voltage source (R13, R14), and generates an output signal for driving the half-bridge inverter (Q10, Q11).

5 Claims, 4 Drawing Sheets

CIRCUIT ARRANGEMENT FOR DETECTING RECTIFICATION OF DISCHARGE LAMPS

Figure 1:
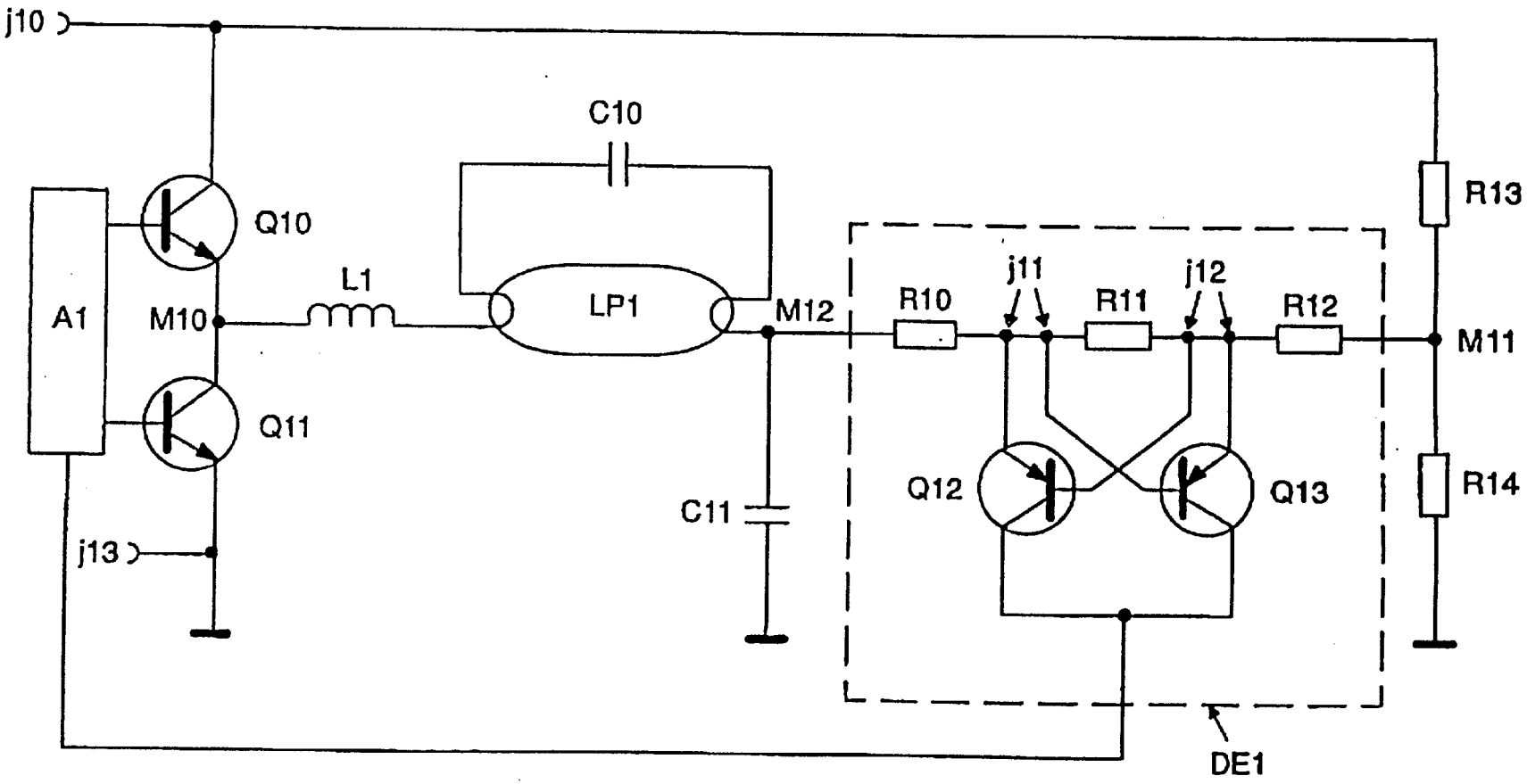

The invention relates to a circuit arrangement for operating at least one discharge lamp in accordance with the preamble of Patent Claim 1.

PRIOR ART

A circuit arrangement corresponding to the preamble of Patent Claim 1 is disclosed, for example, in European Laid-Open Specification EP 0 753 987 A1. This circuit arrangement has a half-bridge inverter with a switch-off device which switches off the half-bridge inverter in the case of an anomalous operating state—for example a lamp which is unwilling to start or defective. The switch-off device has a field effect transistor whose drain-source path is arranged in the control circuit of a half-bridge inverter transistor and switches the control circuit between a low-resistance and a high-resistance state. Upon the occurrence of an anomalous operating state, the switching off is performed synchronously with the blocking phase of that half-bridge inverter transistor in whose control circuit the field effect transistor is arranged. The switch-off device of this circuit arrangement certainly switches off the half-bridge inverter reliably in the case of a lamp unwilling to start, but it reacts generally not sensitively enough to the occurrence of the so-called rectifier effect of the discharge lamp, which will be explained in more detail below.

A possible cause of failure of discharge lamps, in particular of low-pressure discharge lamps, is due to an electron emissivity of the lamp electrodes which is reduced over the service life of the lamp. Since the loss in emissivity generally progresses with different intensity over the service life of the lamp in the case of the two lamp electrodes, a discharge lamp operated with alternating current has developed a preferred direction of the discharge current through the discharge lamp by the end of its service life. The discharge lamp in this case develops a current-rectifying effect. This effect is denoted as the rectifier effect of the discharge lamp. The occurrence of the rectifier effect in the discharge lamp causes extreme heating of the lamp electrode which is incapable of emission, with the result that impermissibly high temperatures can occur, which can even cause melting of the lamp bulb glass.

In the case of discharge lamps which are operated on a half-bridge inverter, the rectifier effect of the discharge lamp causes a conspicuous deviation in the voltage drop across the coupling capacitor or across the coupling capacitors from the normal value, which is usually half as large as the value of the input voltage of the half-bridge inverter. In the case of self-oscillating half-bridge inverters, this deviation in the voltage drop across the coupling capacitor or the coupling capacitors has the effect that the oscillation of the half-bridge inverter is stopped, because the supply voltage of one of the two half-bridge arms is in this case too low to maintain the feedback. However, the oscillation of the half-bridge inverter is restarted immediately after it has been interrupted by the starting circuit of the half-bridge inverter if the switch-off device is not triggered. As a result, the discharge lamp affected by the rectifier effect is not reliably switched off, but flickers instead.

SUMMARY OF THE INVENTION

It is the object of the invention to provide an improved circuit arrangement for operating at least one discharge lamp, which does not have the disadvantages of the prior art. In particular, the circuit arrangement is intended to detect the occurrence of the rectifier effect of the at least one discharge lamp and in this case to switch off the half-bridge inverter permanently or at least to ensure a limitation of the voltage and/or the current in the load circuit to safe values.

This object is achieved according to the invention by means of the characterizing features of Patent Claim 1. Particularly advantageous designs of the invention are described in the subclaims.

The circuit arrangement according to the invention, which has a half-bridge inverter with a drive device and downstream load circuit, at least one coupling capacitor connected to the load circuit and the half-bridge inverter, and terminals with at least one discharge lamp, has a reference voltage source and a detector circuit which compares the voltage drop across the at least one coupling capacitor or the voltage drop, divided downwards by a voltage divider, across the at least one coupling capacitor with the reference voltage of the reference voltage source, and generates an output signal for driving the half-bridge inverter.

As already mentioned further above, the occurrence of the rectifier effect of the at least one discharge lamp causes a conspicuous deviation of the voltage drop across the at least one coupling capacitor from its normal value, which is half as large as the input voltage of the half-bridge inverter. With the aid of the reference voltage source and the detector circuit, the occurrence of the rectifier effect of the at least one discharge lamp is detected by using these means to determine deviations in the voltage drop across the at least one coupling capacitor from its desired value, and generating a corresponding output signal and feeding it to the drive device of the half-bridge inverter, in order either to switch off the half-bridge inverter or, for example by means of a rise in frequency, to regulate the voltage and/or the current in the load circuit down to safe values. For this purpose, the detector circuit of the circuit arrangement according to the invention advantageously has at least two voltage inputs and a voltage output connected to the drive device of the half-bridge inverter, a first voltage input being connected to the reference voltage source, and a second voltage input being connected to the at least one coupling capacitor. In order to be able to switch off the half-bridge inverter upon the occurrence of an anomalous operating state, that is to say in the case of a defective lamp or given the occurrence of some other malfunction, the drive device advantageously has a switch-off device which is fed the output signal of the detector circuit.

The reference voltage source is advantageously designed as a voltage divider which is connected in parallel with the DC voltage input of the half-bridge inverter, and at whose centre tap the reference voltage is provided. Thus, the reference voltage is generated with the aid of simple means from the supply voltage of the half-bridge inverter. The detector circuit advantageously comprises at least two transistors and a voltage divider. The transistors are advantageously pnp bipolar transistors. The voltage divider of the detector circuit advantageously has a first and a second terminal, as well as a first and a second centre tap, the first terminal being connected to the at least one coupling capacitor, and the second terminal being connected to the reference voltage source, and the first centre tap being connected to the emitter of the first pnp transistor and to the base of the second pnp transistor, while the second centre tap is connected to the emitter of the second pnp transistor and to the base of the first pnp transistor. The collector terminals of the pnp transistor are advantageously connected to the voltage output of the detector circuit.

DESCRIPTION OF THE PREFERRED EXEMPLARY EMBODIMENTS

Figure 2:
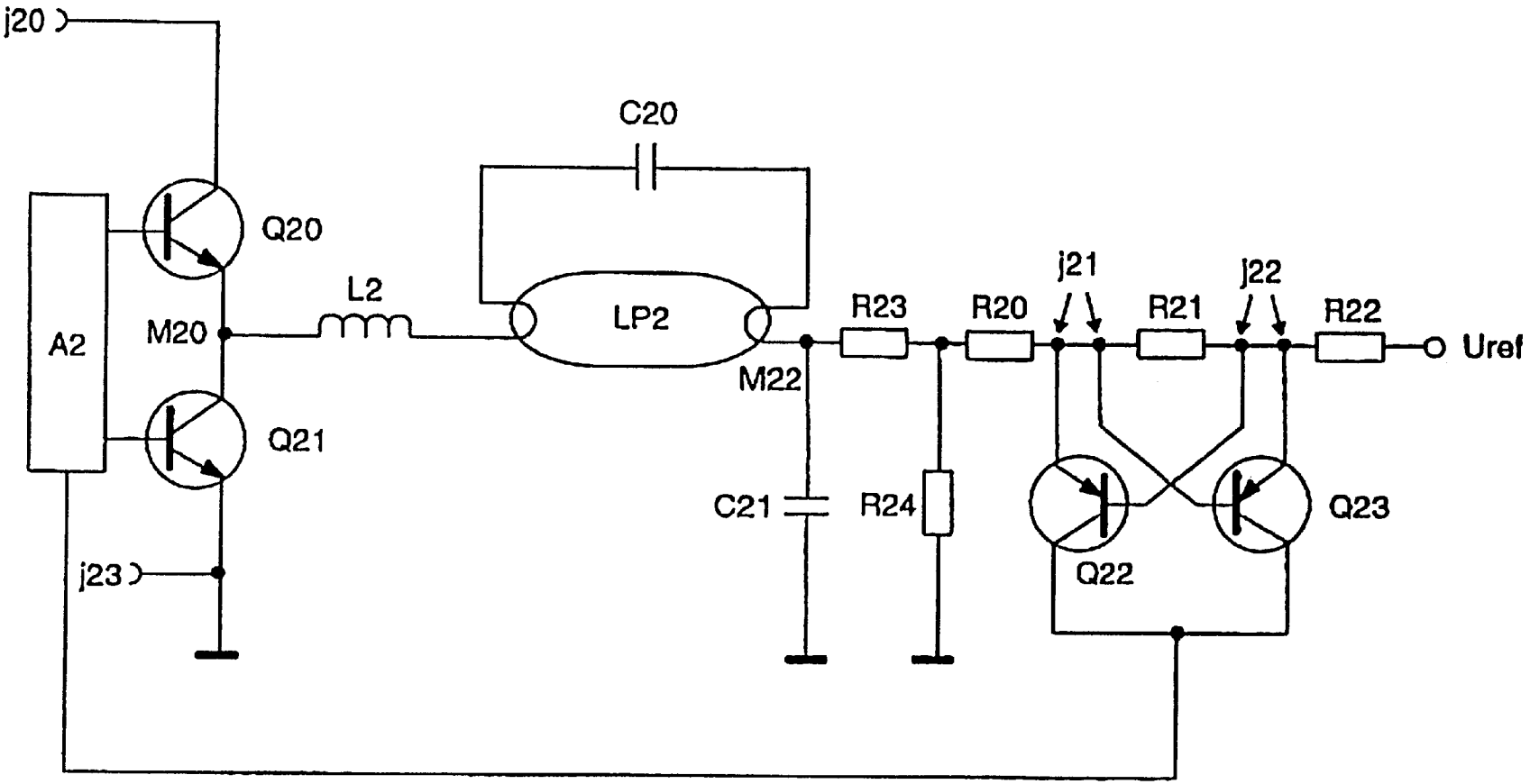
Figure 3:
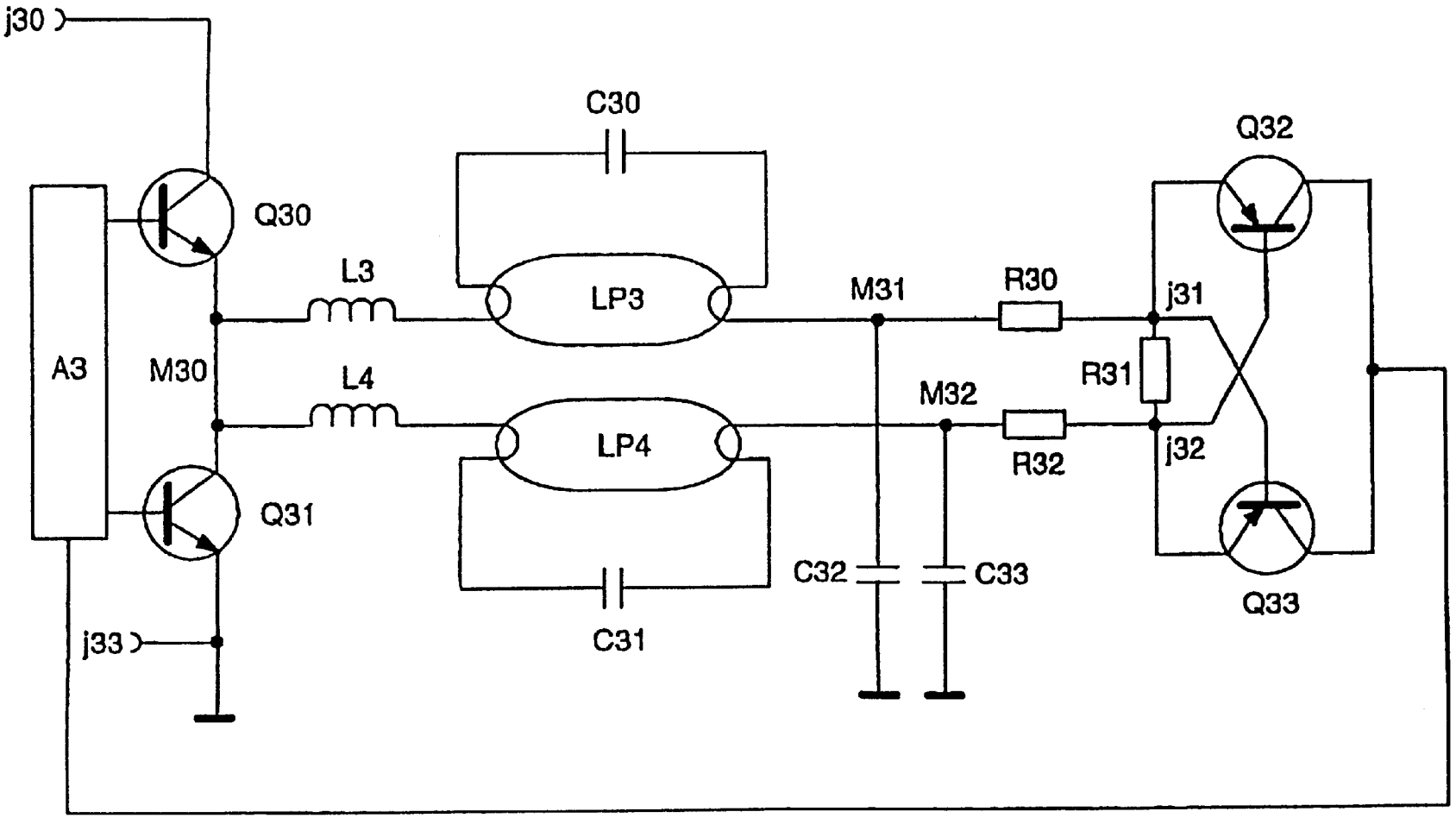
Figure 4:
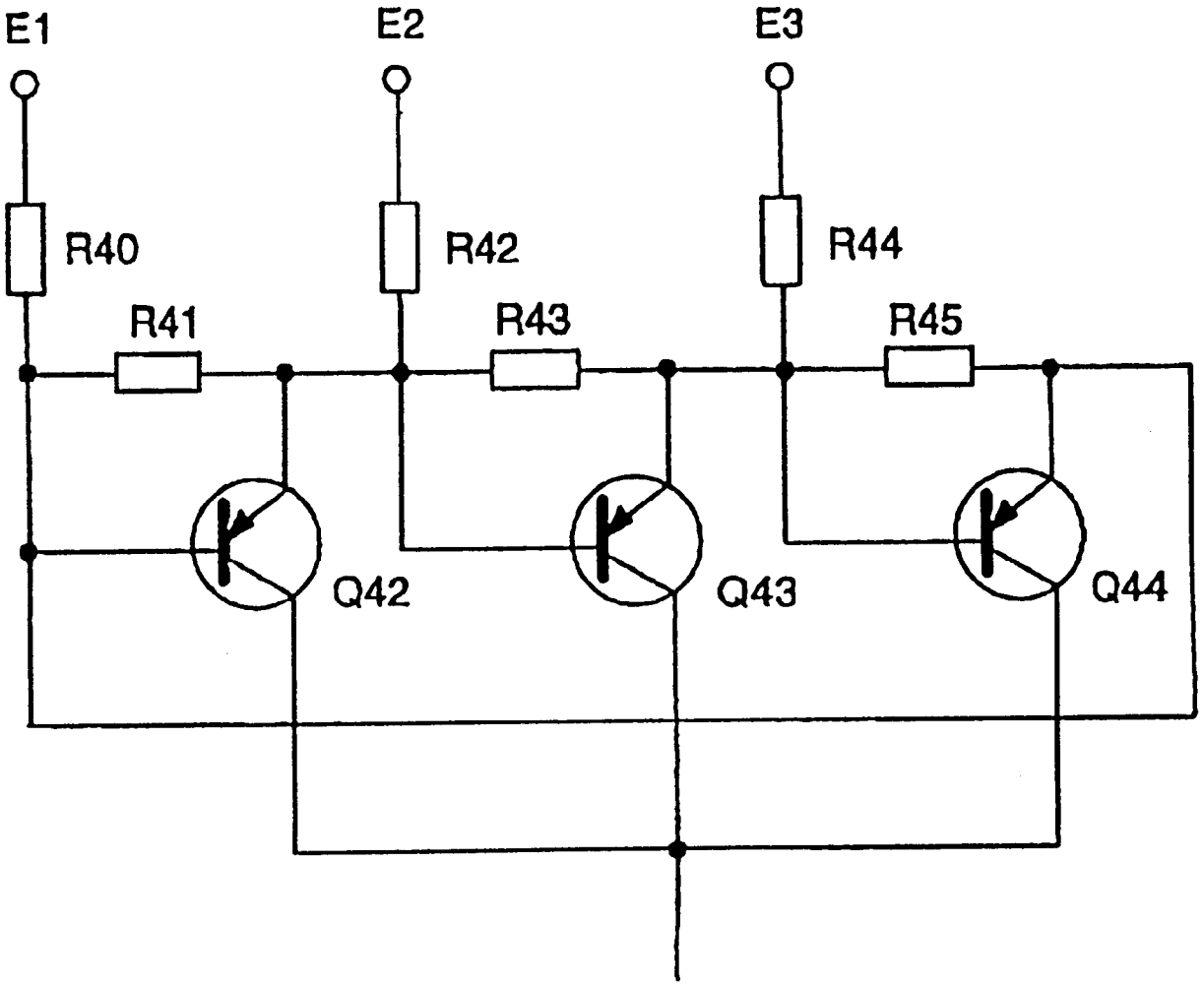

The invention is explained below with the aid of a plurality of exemplary embodiments. In the drawing:

FIG. 1 shows a diagrammatic circuit diagram of a first exemplary embodiment of the circuit arrangement according to the invention for operating a fluorescent lamp, FIG. 2 shows a diagrammatic circuit diagram of a second exemplary embodiment of the circuit arrangement according to the invention for operating a fluorescent lamp, FIG. 3 shows a diagrammatic circuit diagram of a third exemplary embodiment of the circuit arrangement according to the invention for operating two, parallel-connected fluorescent lamps, and FIG. 4 shows a diagrammatic sketch of the detector circuit in accordance with a fourth exemplary embodiment of the invention for operating more than two lamps.

The circuit arrangement illustrated in FIG. 1 serves to operate a so-called T5 fluorescent lamp. This first exemplary embodiment of the invention has two npn transistors Q10, Q11 which are interconnected as a half-bridge inverter and whose control electrodes are connected to the drive device A1 of the half-bridge inverter. The half-bridge inverter Q10, Q11 draws its input or supply voltage via the DC voltage terminals j10, j13. The DC voltage terminal j13 is at frame potential, and a voltage of approximately +400 V is provided at the DC voltage terminal j10. This input or supply voltage is generated from the rectified AC supply voltage in a known way, for example with the aid of an upstream step-up converter (not illustrated in the figures).

The drive device A1 of the half-bridge inverter Q10, Q11 is designed as an integrated circuit which determines the switching cycle of the transistors Q10, Q11. Connected to the centre tap M10 of the half-bridge inverter Q10, Q11 is a load circuit which is designed as a series resonant circuit and has a resonance inductor L1, a resonance capacitor C10 and a fluorescent lamp LP1. A coupling capacitor C11 is connected to the load circuit. The resonance capacitor C10 is connected in parallel with the discharge path of the fluorescent lamp LP1. The positive terminal of the coupling capacitor C11 is connected to the lamp LP1 via the branch point M12, and its negative terminal is at frame potential. The transistors Q10, Q11 switch in an alternating fashion, so that the centre tap M10 of the half-bridge inverter Q10, Q11 is connected alternately to the high potential U (approximately 400 V) of j10 and the frame potential of j13. Since, in the ideal case, the coupling capacitor C11 is charged to half the supply voltage U/2 (approximately 200 V) of the half-bridge inverter, it follows that a medium-frequency alternating current whose frequency is determined essentially by the switching cycle of the transistors Q10, Q11 flows between the centre tap M10 and the branch point M12. During the electrode preheating phase, the alternating current flows via the two lamp electrodes and the resonance capacitor C10. In the starting phase, the starting voltage for the fluorescent lamp LP1 is provided across the resonance capacitor C10, for example by means of the method of resonant increase. After the discharge is started in the lamp LP1, the alternating current flows essentially via the discharge path of the lamp, and the resonance capacitor is virtually bridged.

Moreover, the circuit arrangement has a voltage divider, which comprises the two resistors R13, R14 and their centre tap M11, and a detector circuit DE1. The voltage divider R13, R14 is arranged in parallel with the DC voltage input j10, j13 of the half-bridge inverter. Since the two voltage divider resistors R13, R14 have the same resistance value, half the supply voltage U/2 of the half-bridge inverter Q10, Q11 is present at their centre tap M11.

The detector circuit DE1 has a first voltage input, which is connected to the branch point M12, and thus to the positive terminal of the coupling capacitor C11, and a second voltage input, which is connected to the centre tap M11 of the voltage divider R13, R14, as well as a voltage output connected to the drive device A1. This detector circuit DE1 comprises a voltage divider R10, R11, R12, formed from the three resistors R10, R11, R12, and two pnp bipolar transistors Q12, Q13. The three voltage divider resistors R10, R11, R12 are connected in series between the two taps M12 and M11. The first centre tap j11, situated between the resistors R10, R11, of the voltage divider R10, R11, R12 is connected to the emitter of the first pnp transistor Q12 and to the base of the second pnp transistor Q13. The second centre tap j12, situated between the resistors R11, R12, of the voltage divider R10, R11 R12 is connected to the emitter of the second pnp transistor Q13 and to the base of the first pnp transistor Q12. The collectors of the two transistors Q12, Q13 are interconnected and form the voltage output of the detector circuit DE1.

As already mentioned above, in the ideal case half the input voltage U/2 of the half-bridge inverter is present at the two taps M11 and M12, so that in the ideal case no voltage drop occurs across the voltage divider R10, R11, R12, and the pnp transistors Q12, Q13 are not driven. Owing to the occurrence of the rectifier effect in the lamp LP1, a preferred direction is formed for the lamp current. As a result, the voltage drop across the coupling capacitor C11 changes, and thus also the potential at the tap M12. The potential at the tap M12 deviates upwards or downwards from the ideal value U/2 as a function of the preferred lamp current direction. This deviation of the potential at the tap M12 from the ideal value U/2 causes a voltage drop across the voltage divider R10, R11, R12. The voltage divider R10, R11, R12 then generates a drive signal for the base of one of the pnp transistors Q12 or Q13. If the potential at the tap M12 is, for example, lower than U/2, the base of the second pnp transistor Q13 is driven. If, by contrast, the potential at the tap M12 is displaced to a higher value than U/2, the base of the first pnp transistor Q12 is driven. The pnp transistor Q12 or Q13 switches on when the voltage difference between its base and its emitter is −0.6 V. That is to say, if the voltage drop across the voltage divider resistor R11 is at least 0.6 V, one of the two pnp transistors Q12 or Q13 turns on, depending on the polarization of the voltage across the resistor R11. The response threshold of the two pnp transistors Q12, Q13 can therefore be set by a suitable dimensioning of the voltage divider resistors R10, R11, R12. It must be set relatively high, because deviations of the potential at the tap M12 from the ideal value already occur in the case of regular lamp operation. In the first exemplary embodiment, the resistor R11 is dimensioned such that the pnp transistor Q12 or Q13 is not turned on until there is a deviation of the potential at the tap M12 of approximately 100 V from the ideal value U/2. That is to say, the transistor Q13 is turned on when the voltage drop across the coupling capacitor C11 is only 100 V or less instead of 200 V, and the transistor Q12 is turned on when the voltage drop across the coupling capacitor C11 has risen from 200 V to at least 300 V. In both aforementioned cases, the detector circuit DE1 generates an output signal for the drive device A1 of the half-bridge inverter Q10, Q11, which is preferably used to turn off the half-bridge inverter Q10, Q11. However, it can also be used to limit the voltage and/or the current in the load circuit, for example by raising the control frequency of the half-bridge inverter transistors Q10, Q11. A dimensioning of the components of the circuit arrangement in accordance with the first exemplary embodiment is specified in Table 1.

In accordance with the second exemplary embodiment of the invention, illustrated in FIG. 2, the circuit arrangement has two npn transistors Q20, Q21 which are interconnected as a half-bridge inverter and whose control electrodes are connected to the drive device A2 of the half-bridge inverter. The half-bridge inverter Q20, Q21 draws its input or supply voltage via the DC voltage terminals j20, j23. The DC voltage terminal j23 is at frame potential, and a voltage of approximately +400 V is provided at the DC voltage terminal j20. This input or supply voltage is generated from the rectified AC supply voltage in a known way, for example with the aid of an upstream step-up converter (not illustrated in the figures).

The drive device A2 of the half-bridge inverter Q20, Q21 is designed as an integrated circuit which determines the switching cycle of the transistors Q20, Q21. Connected to the centre tap M20 of the half-bridge inverter Q20, Q21 is a load circuit which is designed as a series resonant circuit and has a resonance inductor L2, a resonance capacitor C20 and a fluorescent lamp LP2. A coupling capacitor C21 is connected to the load circuit. The resonance capacitor C20 is connected in parallel with the discharge path of the fluorescent lamp LP2. The positive terminal of the coupling capacitor C21 is connected to the lamp LP2 via the branch point M22, and its negative terminal is at frame potential. The transistors Q20, Q21 switch in an alternating fashion, so that the centre tap M20 of the half-bridge inverter Q20, Q21 is connected alternately to the high potential U (approximately 400 V) of j20 and the frame potential of j23. Since, in the ideal case, the coupling capacitor C21 is charged to half the supply voltage U/2 (approximately 200 V) of the half-bridge inverter, it follows that a medium-frequency alternating current whose frequency is determined essentially by the switching cycle of the transistors Q20, Q21 flows between the centre tap M20 and the branch point M22.

Moreover, the circuit arrangement in accordance with the second exemplary embodiment has a reference voltage source $U_{ref}$ and a detector circuit as well as a voltage divider R23, R24, which is connected to the coupling capacitor C21 and divides the coupling capacitor voltage U/2 downward in the ratio of the resistance values of the voltage divider resistors R23, R24. In the second exemplary embodiment, the detector circuit comprises the voltage divider resistors R20, R21, R22 and the pnp small-signal transistors Q22, Q23. This detector circuit is designed exactly like the detector circuit DE1 of the first exemplary embodiment. Its voltage inputs are, however, connected to the centre tap of the voltage divider R23, R24 and to the reference voltage source $U_{ref}$. The essential difference from the first exemplary embodiment consists in that the detector circuit of the second exemplary embodiment does not—as in the case of the first exemplary embodiment—detect the voltage drop across the coupling capacitor C21, but instead monitors the voltage drop across the voltage divider resistor R24 and compares it with the reference voltage of the reference voltage source $U_{ref}$. The reference voltage $U_{ref}$ is approximately +5 V and is generated with the aid of an auxiliary voltage source. The voltage drop across the coupling capacitor C21 is divided downwards with the aid of the voltage divider R23, R24 in the ratio of 1/39, with the result that in the ideal case a voltage of approximately +5 V is likewise present across the resistor R24, since the voltage drop across the coupling capacitor C21 is equal in the ideal case to half the supply voltage U/2 of the half-bridge inverter Q20, Q21, that is to say is approximately equal to 200 V. Detector circuit R20, R21, R22, Q22, Q23 with the centre taps j21, j22 for the emitter and base terminals of the transistors Q22, Q23 otherwise functions precisely like the detector circuit DE1 of the first exemplary embodiment. The sole difference consists in that the detector circuit of the second exemplary embodiment (FIG. 2) operates with substantially lower input voltages at its voltage inputs in the case of R20 and R22 than the detector circuit DE1 of the first exemplary embodiment. This has the advantage that small-signal transistors Q22, Q23 can be used in the detector circuit of the second exemplary embodiment. The mode of operation of the detector circuits of the two first exemplary embodiments is, however, otherwise the same. If the voltage across the coupling capacitor C21 drops, for example, to a value below 100 V the voltage drop across the resistor R24 is less than 2.5 V. The transistor Q23 then turns on. If the voltage across the coupling capacitor C21 rises to more than 300 V, the voltage drop across the resistor R24 is more than 7.5 V. The transistor Q22 then turns on. In both cases, the detector circuit supplies an output signal for the drive device A2 of the half-bridge inverter Q20, Q21 which is preferably used to switch off the half-bridge inverter Q20, Q21. A suitable dimensioning of the components of the circuit arrangement in accordance with the second exemplary embodiment of the invention is specified in Table 2.

The third exemplary embodiment (FIG. 3) describes the application of the invention to a circuit arrangement for operating two parallel-connected fluorescent lamps LP3, LP4. This circuit arrangement has two npn transistors Q30, Q31, interconnected as a half-bridge inverter, whose control electrodes are connected to the drive device A3 of the half-bridge inverter. The half-bridge inverter Q30, Q31 draws its input or supply voltage via the DC voltage terminals j30, j33. The DC voltage terminal j33 is at frame potential, and a voltage of approximately +400 V is provided at the DC voltage terminal j30. This input or supply voltage is generated from the rectified AC supply voltage in a known way, for example with the aid of an upstream step-up converter (not illustrated in the figures).

The drive device A3 of the half-bridge inverter Q30, Q31 is designed as an integrated circuit which determines the switching cycle of the transistors Q30, Q31. Two parallel-connected load circuits designed as series-resonant circuits are connected to the centre tap M30 of the half-bridge inverter Q30, Q31. The two load circuits each have a resonance inductor L3 and L4, respectively, a resonance capacitor C30 and C31, respectively, and a fluorescent lamp LP3 and LP4, respectively. A coupling capacitor C32 or C33 is respectively connected to the two load circuits. In the ideal case, half the supply voltage U/2 of the half-bridge inverter Q30, Q31 is present across the two coupling capacitors C32, C33. The potentials at the taps M31, M32 are thus U/2 in the ideal case, that is to say approximately +200 V. A voltage input of a detector circuit comprising the voltage divider resistors R30, R31, R32 and the pnp transistors Q32, Q33 is connected in each case to the taps M31 and M32. The voltage output of this detector circuit is formed by the interconnected collectors of the pnp transistors Q32, Q33. It is connected to the drive circuit A3 of the half-bridge inverter Q30, Q31. The first centre tap j31 of the voltage divider R30, R31, R32 is connected to the emitter of the first pnp transistor Q32 and to the base of the second pnp transistor Q33, while its second centre tap j32 is connected to the emitter of the second pnp transistor Q33 and the base of the first pnp transistor Q32. The detector circuit of the third exemplary embodiment monitors the voltage drop across the two coupling capacitors C32 and C33, by virtue of the fact that one coupling capacitor C32 or C33 serves as reference voltage source for the respective other coupling capacitor C33 or C32.

If, for example, the rectifier effect occurs in the case of the first lamp LP3, with the result that the voltage drop across the first coupling capacitor C32 deviates by more than 100 V from the ideal value U/2=200 V, and is more than 300 V, for example, the first pnp transistor Q32 is turned on. Specifically, in the ideal case half the supply voltage U/2=200 V of the half-bridge inverter Q30, Q31 is still present across the other coupling capacitor C33, which in this case serves as reference voltage source. If the voltage across the first coupling capacitor C32 drops to a value below 100 V, the second pnp transistor Q33 is turned on.

If, by contrast, the rectifier effect occurs in the case of the second lamp LP4, the voltage drop across the second coupling capacitor C33 deviates from the ideal value U/2=200 V. For example, if the voltage drop across the second coupling capacitor C33 rises to more than 300 V, the second pnp transistor Q33 is turned on. Specifically, in the ideal case half the supply voltage U/2=200 V of the half-bridge inverter Q30, Q31 is still present across the first coupling capacitor C32, which serves in this case as reference voltage source. If the voltage across the second coupling capacitor C33 drops, however, to a value below 100 V, the first pnp transistor Q32 is turned on.

In all the abovementioned cases, in which one of the two pnp transistors Q32 or Q33 is turned on, the detector circuit generates at its voltage output a drive signal for the drive device A3 of the half-bridge inverter Q30, Q31, which is preferably used to switch off the half-bridge inverter Q30, Q31. The detector circuit of the third exemplary embodiment thus operates in an entirely analogous fashion to the detector circuit DE1 of the first exemplary embodiment. In the unlikely case that the rectifier effect occurs simultaneously in the case of both lamps LP3, LP4, however, the detector circuit of the third exemplary embodiment does not function. A suitable dimensioning of the components used in the case of the third exemplary embodiments [sic] is specified in Table 3.

FIG. 4 shows a detector circuit with three voltage inputs E1, E2, E3 for a circuit arrangement with a half-bridge inverter to whose centre tap three parallel-connected load circuits are connected. Each of the voltage inputs E1, E2, E3 is connected to the terminal, at a positive potential, of the coupling capacitor of one of the load circuits. This detector circuit compares the voltage drop across the coupling capacitors of the three load circuits with one another. It operates in a completely analogous fashion to the detector circuit of the third exemplary embodiment. The detector circuit illustrated in FIG. 4 comprises three pnp transistors Q42, Q43, Q44, three base-emitter resistors R41, R43, R45 and three series resistors R40, R42, R44. The interconnected collectors of the pnp transistors Q42, Q43, Q44 form the voltage output of the detector circuit.

If, for example, the potential at the input E1 or E2 or E3 is raised beyond the response threshold by comparison with the potential at the other two inputs, the transistor Q44 or Q42 or Q43 turns on. If the potential at the input E1 or E2 or E3 is lowered below the response threshold by comparison with the potential at the other two inputs, the transistor Q42 or Q43 or Q44 turns on. In all the aforementioned cases, a drive signal for the drive device of the half-bridge inverter is produced at the voltage output of the detector circuit. This detector circuit can also be adapted to more than three parallel-connected load circuits by the addition of further pnp transistors and base-emitter resistors, as well as further series resistors.

The invention is not limited to the exemplary embodiments explained in more detail above. For example, the pnp transistors of the detector circuits can also be replaced by field effect transistors with a similar current/voltage characteristic. However, npn transistors can also be used instead of pnp transistors for the detector circuit. It is then necessary only to ensure with the aid of suitable means that control signals of the correct polarity are applied by the detector circuit to the drive device of the half-bridge inverter.

TABLE 1

| Dimensioning of the electric components in accordance with the first exemplary embodiment | |
|---|---|
| L1 | 1.6 mH |
| C10 | 7.5 nF |
| C11 | 68 nF |
| R10, R12 | 390 kΩ |
| R11 | 4.7 kΩ |
| R13, R14 | 470 kΩ |
| Q12, Q13 | BF421 |

TABLE 2

| Dimensioning of the electric components in accordance with the second exemplary embodiment | |
|---|---|
| L2 | 1.6 mH |
| C20 | 7.5 nF |
| C21 | 68 nF |
| $U_{ref}$ | +5 V |
| R20, R22 | 10 kΩ |
| R21 | 6.2 kΩ |
| R23 | 390 kΩ |
| R24 | 10 kΩ |
| Q22, Q23 | BC807 |

TABLE 3

| Dimensioning of the electric components in acoordance with the second exemplary embodiment | |
|---|---|
| L3, L4 | 1.6 mH |
| C30, C31 | 7.5 nF |
| C32, C33 | 68 nF |
| R30, R32 | 390 kΩ |
| R31 | 4.7 kΩ |
| Q32, Q33 | BF421 |

What is claimed is:

1. Circuit arrangement for operating at least two discharge lamps, the circuit arrangement having the following features:

a half-bridge inverter (Q10, Q11; Q20, Q21; Q30, Q31) with at least two downstream load circuits (L1, C10, LP1; L2, C20, LP2; L3, C30, LP3; L4, C31, LP4), first and second coupling capacitors (C11; C21; C32, C33) each connected to a respective load circuit (L1, C10, LP1; L2, C20, LP2; L3, C30, LP3; L4, C31, LP4) and to the half-bridge inverter (Q10, Q11; Q20, Q21; Q30, Q31), a drive device (A1; A2; A3) for the half-bridge inverter (Q10, Q11; Q20, Q21; Q30, Q31), each load circuit (L1, C10, LP1; L2, C20, LP2; L3, C30, LP3; L4, C31, LP4) has terminals for at least one discharge lamp (LP1; LP2; LP3; LP4)

characterized in that the circuit arrangement has a reference voltage source across either the first or second coupling capacitor (C32, C33) and a detector circuit (DE1; R20, R21, R22, Q22, Q23; R30, R31, R32; Q32, Q33) which compares the voltage drop across the other of the first or second coupling capacitor (C32, C33) with the reference voltage of the reference voltage source (C32, C33), and generates an output signal for driving the half-bridge inverter (Q10, Q11; Q20, Q21; Q30, Q31).

2. Circuit arrangement according to claim 1, characterized in that the drive device (A1; A2; A3) includes a switch-off device which switches off the half-bridge inverter (Q10, Q11; Q20, Q21; Q30, Q31) on the occurrence of an anomalous operating state.

3. Circuit arrangement according to claim 1, characterized in that the detector circuit comprises at least two transistors (Q12, Q13; Q22, Q23; Q32, Q33) and one voltage divider (R30, R31, R32).

4. Circuit arrangement according to claim 3, characterized in that the transistors (Q12, Q13; Q22, Q23; Q32, Q33) are pnp bipolar transistors.

5. Circuit arrangement according to claim 4, characterized in that the voltage divider (R30, R31, R32) has a first and a second terminal as well as a first (j31) and a second (j32) centre tap the first terminal being connected to the first coupling capacitor (C32 or C33), the second terminal being connected to the reference voltage source across the second coupling capacitor (C33 or C32), the first centre tap (j31) being connected to the emitter of the first transistor (Q32) and to the base terminal of the second transistor (Q33), the second centre tap (j32) being connected to the emitter of the second transistor (Q33) and to the base terminal of the first transistor (Q32), and the collector terminals of the transistors (Q32, Q33) being connected to the voltage output of the detector circuit.

* * * * *